US009061496B2

(12) United States Patent
Shimomura et al.

(10) Patent No.: US 9,061,496 B2
(45) Date of Patent: Jun. 23, 2015

(54) PRINTER

(71) Applicant: RISO KAGAKU CORPORATION, Tokyo (JP)

(72) Inventors: Kenji Shimomura, Ibaraki (JP); Hiroshi Hayashi, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 13/922,536

(22) Filed: Jun. 20, 2013

(65) Prior Publication Data

US 2014/0009528 A1 Jan. 9, 2014

(30) Foreign Application Priority Data

Jul. 3, 2012 (JP) ..... 2012-149441

(51) Int. Cl.

| | |
|---|---|
| ***B41J 2/165*** | (2006.01) |
| ***B41J 2/135*** | (2006.01) |
| ***B41J 2/21*** | (2006.01) |
| ***B41J 3/01*** | (2006.01) |

(52) U.S. Cl.

CPC ..... *B41J 2/135* (2013.01); *B41J 2/2132* (2013.01); *B41J 3/01* (2013.01)

(58) Field of Classification Search

None

See application file for complete search history.

(56) References Cited

U.S. PATENT DOCUMENTS

| | | | | |
|---|---|---|---|---|
| 7,396,106 | B2 * | 7/2008 | Fukuyasu | 347/41 |
| 2006/0203019 | A1 * | 9/2006 | Yamanobe | 347/12 |
| 2009/0166401 | A1 * | 7/2009 | Quine | 229/300 |

FOREIGN PATENT DOCUMENTS

JP 2003-237059 A 8/2003

* cited by examiner

*Primary Examiner* — Alejandro Valencia

(74) *Attorney, Agent, or Firm* — Nath, Goldberg & Meyer; Jerald L. Meyer; Tiffany A. Johnson

(57) ABSTRACT

A printer includes a first printing unit configured in printing a code image to form first dots on respective pixels of the code image and a second printing unit configured in printing the code image to form second dots between the first dots in a width direction of a region with a width of two or more pixels having the first dots formed by the first printing unit.

5 Claims, 5 Drawing Sheets

31

| TYPE OF SHEET | NUMBER OF DROPS OF K | NUMBER OF DROPS OF C |
|---|---|---|
| SHEET A | 5 | 2 |
| SHEET B | 4 | 2 |
| SHEET C | 2 | 1 |
| ... | ... | ... |

31

| TYPE OF SHEET | NUMBER OF DROPS OF K | NUMBER OF DROPS OF C |
|---|---|---|
| SHEET A | 5 | 2 |
| SHEET B | 4 | 2 |
| SHEET C | 2 | 1 |
| ... | ... | ... |

FIG. 10
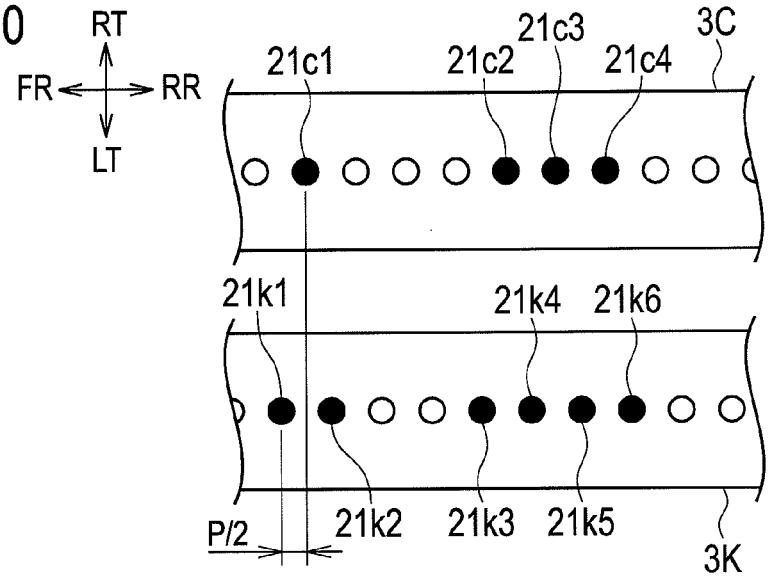
FIG. 11
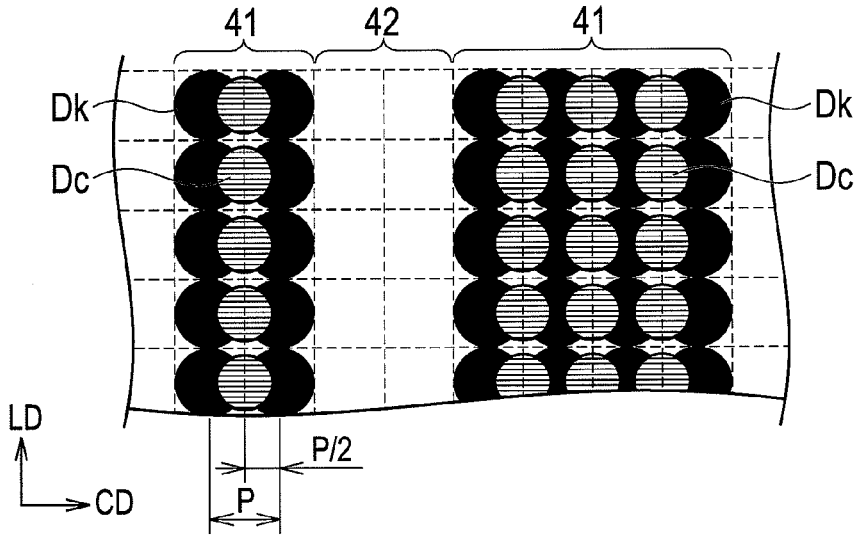
FIG. 12
| TYPE OF SHEET | EFFECT OF IMPROVEMENT IN BARCODE QUALITY | | |
|---|---|---|---|
| | EXAMPLE 1 | EXAMPLE 2 | COMPARATIVE EXAMPLE |
| IJ MATTE SHEET | A | A | B |
| IJ SHEET | A | A | B |
| PLAIN SHEET A | B | A | B |
| PLAIN SHEET B | A | B | C |

PRINTER

CROSS REFERENCE TO RELATED APPLICATION

This application is based upon and claims the benefit of priority from the prior Japanese Patent Application No. 2012-149441, filed on Jul. 3, 2012, the entire contents of which are incorporated herein by reference.

BACKGROUND

1. Technical Field

The present invention relates to a printer configured to print on a print medium.

2. Related Art

Information codes are known, such as a barcode or a two-dimensional code typified by a QR code (registered trademark). In view of high-mix, small-lot production, on-demand printing is drawing attention for printing an image of an information code (a code image) on paper or the like. In particular, a line inkjet head printer, with which high-speed printing is easy, is expected to be used to print a code image.

An information code represents information by, for example, the widths of bars or the arrangement of cells that constitute the code. Hence, if the widths of the bars in a printed barcode are different from prescribed widths, the barcode readability by a reader is degraded. For this reason, high printing accuracy is required in code image printing.

In printing such as inkjet printing which forms an image on a print medium by use of dots, the dots tend to increase in their size due to, for example, bleeding of ink. For this reason, when a barcode is printed using an inkjet printer for example, the barcode readability by a reader might be degraded due to bleeding of ink which makes the widths of the bars larger than the prescribed widths. When the barcode is printed on a sheet on which ink easily bleeds, the above-mentioned problem of the degradation in the barcode readability occurs more likely.

To overcome such a problem, it is known to reduce the amount of ink ejected by an inkjet printer to form one dot when it prints a code image. Moreover, Japanese Patent Application Publication No. 2003-237059 discloses an inkjet printer which reduces the amount of ink ejected for dots in an edge portion of each print region of a code image from the amount of ink ejected for the other dots.

By thus reducing at least the amount of ink ejected for dots in the edge portions among the dots forming a code image and thereby decreasing the size of these dots, for example, the bars of the code image are prevented from being printed wider than the prescribed widths.

SUMMARY

However, when the dots forming a code image are decreased in size, spaces are produced between the dots, lowering the density of the code image. As a result, for example, when the density of black bars in a barcode is low, the contrast between the bars and white spaces is low, which leads to the degradation in the barcode readability by a reader.

The lower the print resolution, the larger the spaces produced between the dots decreased in size. For this reason, even when the dots forming a code image are decreased in size, a printer having high print resolution can reduce the areas of the spaces produced between the dots, and consequently can alleviate decrease in the density of the code image.

However, high-resolution printing requires a sophisticated printing unit. For example, in a case of an inkjet printer, a sophisticated inkjet head capable of high-resolution printing is needed.

In the case of decreasing the size of only the dots in the edge portion of a print region, it is not easy to print the black bars in a barcode, for example, exactly with their desired widths unless the size of the dots can be controlled with high accuracy. In particular, when the code image is printed on a sheet with ink, such as oil-based ink, which is very likely to bleed on a sheet, it is difficult to control the size of the dots as desired.

To minutely control the size of the dots, the printing unit needs to be sophisticated. For example, an inkjet printer needs a sophisticated inkjet head capable of minutely controlling the amount of ink ejected per dot.

The present invention aims to provide a printer capable of printing a code image with degradation in readability suppressed without requiring a sophisticated printing unit.

A printer in accordance with some embodiments includes a first printing unit configured to apply a first recording material on a print medium to form a dot on the print medium, and a second printing unit configured to apply a second recording material on the print medium with the dot formed by the first printing unit to form a dot on the print medium. In printing a code image, the first printing unit is configured to form first dots on respective pixels of the code image. In printing the code image, the second printing unit is configured to form second dots between the first dots in a width direction of a region with a width of two or more pixels having the first dots formed by the first printing unit.

According to the above configuration, in printing a code image, in a region with a width of two or more pixels having first dots formed by a first printing unit, a second printing unit forms second dots between the first dots in a width direction of the region. Thereby, a code image in which degradation in readability is suppressed can be printed without requiring sophisticated printing units capable of high resolution printing or the like.

An amount per dot of one of the first recording material applied by the first printing unit and the second recording material applied by the second printing unit in printing the code image may be equal to or less than an amount per dot of the other recording material.

According to the above configuration, in printing the code image, the amount of one of the recording material applied per dot by the first printing unit and the recording material applied per dot by the second printing unit is equal to or less than the amount of the other recording material applied per dot. Thereby, bleeding of the recording material or the like due to increase in the amount of the recording material applied can be suppressed. As a result, a code image in which degradation in readability is suppressed can be printed.

An amount of the first recording material applied by the first printing unit and an amount of the second recording material applied by the second printing unit in printing the code image may depend on a type of the print medium.

According to the above configuration, in printing the code image, the amount of the first recording material applied by the first printing unit and the amount of the second recording material applied by the second printing unit are adjusted according to the type of the print medium. Thereby, a code image in which degradation in readability is suppressed can be printed on various types of sheet.

BRIEF DESCRIPTION OF DRAWINGS

FIG. 10 is a diagram showing nozzles used for ejection in barcode printing.

FIG. 11 is a diagram showing dots of a printed barcode image.

FIG. 12 is a diagram showing results of experiments for confirming effects of quality improvement in barcode image by the embodiment.

DETAILED DESCRIPTION

Figure 1:
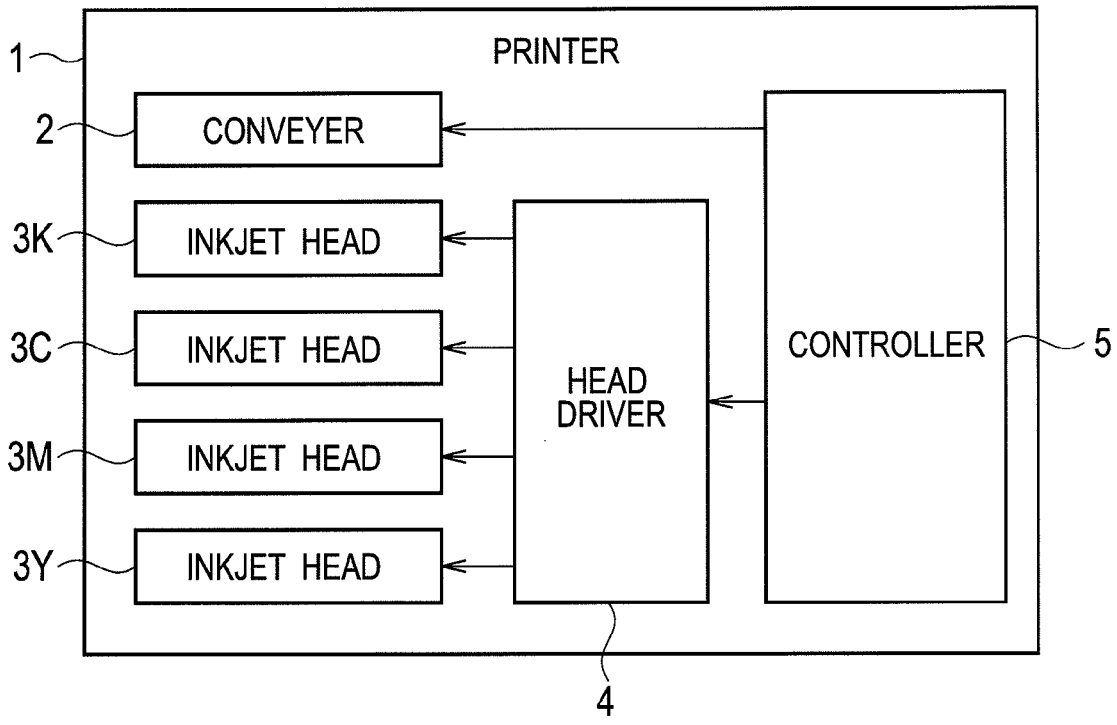
FIG. 1 is a block diagram showing the configuration of a printer according to an embodiment.

With reference to the drawings, an embodiment of the present invention is described below. Throughout the drawings, the same or like portions or elements are denoted by the same or like reference numerals. In addition, it should be noted that the drawings are only schematic and ratios of dimensions and the like are different from actual ones. Moreover, the drawings naturally include portions having different dimensional relationships and ratios from each other.

The embodiment is given below only to provide an example of a machine and the like for embodying a technical concept of the present invention, and the technical concept of the present invention does not limit the arrangement of elements and the like to what is described below. The technical concept of the present invention can be variously changed without departing from the scope of claims.

Figure 2:
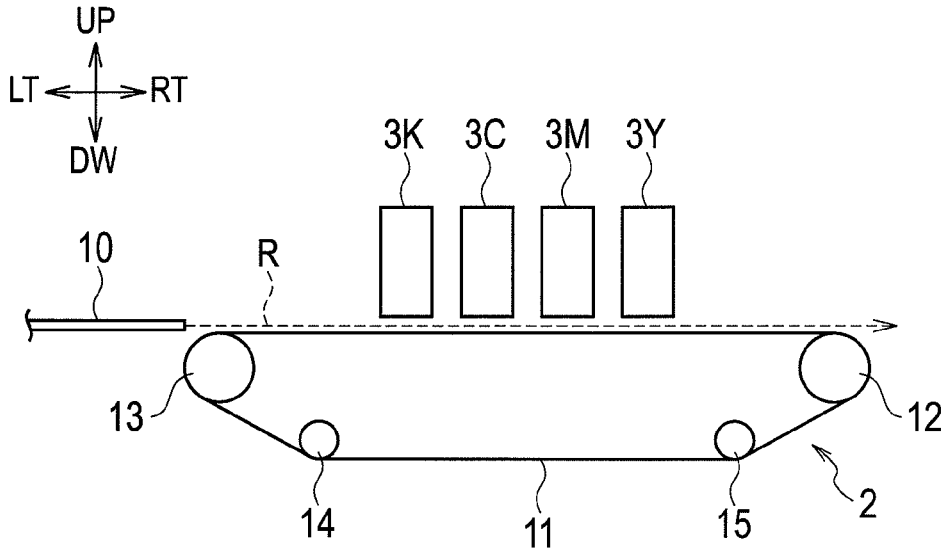
FIG. 2 is a diagram schematically showing the configurations of a conveyer and inkjet heads.

FIG. 1 is a block diagram showing the configuration of a printer according to the embodiment of the present invention. FIG. 2 is a diagram schematically showing the configuration of a conveyer and inkjet heads of the printer shown in FIG. 1. In the following description, a direction orthogonal to the plane of FIG. 2 is a front direction and a rear direction, where a direction from the front side of the plane is a front. The front direction and the rear direction are denoted in the drawings as FR and RR, respectively. Further, as shown in FIG. 2, up, down, left, and right seen from the front is an up direction, a down direction, a left direction, and a right direction, and they are denoted in the drawings as UP, DW, LT, and RT, respectively. A path shown in FIG. 2 with a broken line is a conveyance path R along which a sheet as a print medium is conveyed, and its conveyance direction is from the left to the right. In the following description, upstream and downstream mean those in the conveyance direction. In addition, LD and CD shown in FIGS. 7 and 11 denote a longitudinal direction and a crosswise direction, respectively.

As shown in FIG. 1, a printer 1 according to the embodiment is an inkjet printer, and includes a conveyer 2, inkjet heads 3K, 3C, 3M, and 3Y, a head driver 4, and a controller 5.

The conveyer 2 is configured to convey a sheet 10. As shown in FIG. 2, the conveyer 2 includes a conveyer belt 11, a driven roller 12, and follower rollers 13 to 15.

The conveyer belt 11 is an annular belt fitted over the driven roller 12 and the follower rollers 13 to 15. The conveyer belt 11 has a number of belt holes to suck and hold the sheet 10. The conveyer belt 11 sucks and holds the sheet 10 by use of sucking force generated in the belt holes by a fan (not shown). The conveyer belt 11 is rotated clockwise in FIG. 2 by the driven roller 12 being driven, and thereby conveys the sheet 10, which is sucked and held thereon, rightward.

The conveyer belt 11 is fitted over the driven roller 12 and the follower rollers 13 to 15. The driven roller 12 rotates the conveyer belt 11 by being driven by a motor (not shown). The follower rollers 13 to 15 follow the rotation of the driven roller 12 via the conveyer belt 11. The follower roller 13 is placed at a position which is at substantially the same height as the driven roller 12 and spaced away from the driven roller 12 by a predetermined distance in the left-right direction. The follower rollers 14 and 15 are placed at substantially the same height as each other below the driven roller 12 and the follower roller 13 and spaced away from each other by a predetermined distance in the left-right direction.

The inkjet heads 3K, 3C, 3M, and 3Y are each configured to print an image by ejecting (applying) ink (a recording material) to form ink dots on the sheet 10 being conveyed by the conveyer 2. The inkjet heads 3K, 3C, 3M, and 3Y are configured to eject inks of black (K), cyan (C), magenta (M), and yellow (Y), respectively. The inkjet heads 3K, 3C, 3M, and 3Y are arranged above the conveyer 2. The inkjet heads 3K, 3C, 3M, and 3Y are arranged side by side in this order from the upstream side.

Figures 3, 4:
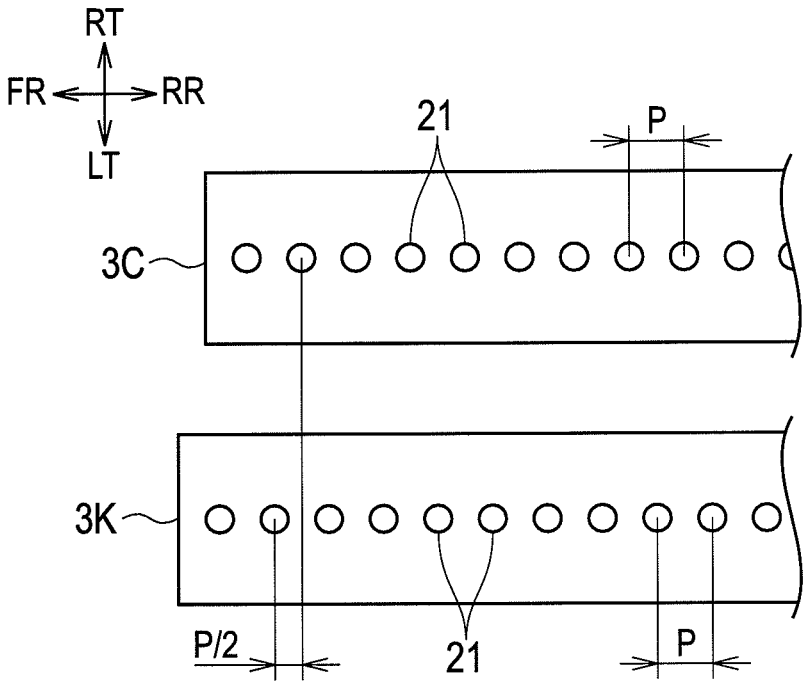
FIG. 3 is a diagram schematically showing the configuration of the inkjet heads.
FIG. 4 is a diagram showing an example of a table for the number of drops for code printing.

As shown in FIG. 3, the inkjet head 3K has, at its lower surface, multiple nozzles 21 from which ink is ejected. The multiple nozzles 21 are arranged in the front-rear direction (a main scanning direction) at equal intervals of a predetermined pitch P. The inkjet heads 3C, 3M, and 3Y has the same configuration as the inkjet head 3K except for the color of ink they eject, and each have multiple nozzles 21 arranged in the front-rear direction at equal intervals of the predetermined pitch P.

As shown in FIG. 3, the inkjet head 3C (a second printing unit) is arranged with the nozzles 21 thereof displaced rearward from those of the inkjet head 3K (a first printing unit) by a half pitch (P/2). FIG. 3 shows the inkjet heads 3K and 3C from below. Although not shown in FIG. 3, the inkjet heads 3M and 3Y are arranged with their nozzles 21 located at the same positions as those of the inkjet head 3K in the front-rear direction. In other words, the inkjet head 3C is displaced rearward from the other inkjet heads 3K, 3M, and 3Y by the half pitch (P/2).

The head driver 4 is configured to drive the inkjet heads 3K, 3C, 3M, and 3Y so that ink may be ejected from their nozzles 21.

The controller 5 is configured to control the operation of each part of the printer 1. The controller 5 includes a CPU, a RAM, a ROM, a hard disk, and the like.

The controller 5 stores in advance a table 31 for the number of drops for code printing. The printer 1 uses black ink and cyan ink to print a barcode image. The table 31 for the number of drops for code printing is a table which holds, for each type of sheet, the number of drops (the amount) of black (K) ink and that of cyan (C) ink ejected per dot in forming a barcode image.

In the printer 1, the maximum number of drops for each type of sheet is set so that $Sm=\pi P^2/2$ holds, where Sm is the area of one dot formed by the maximum number of drops. The maximum number of drops is the maximum number of drops of ink ejected to form one dot.

Figure 5:
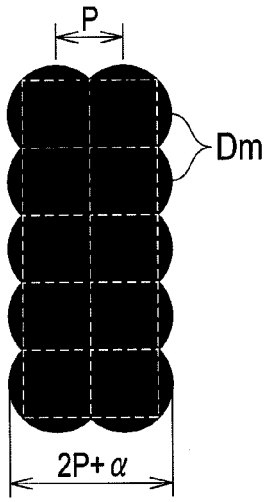
FIG. 5 is a diagram showing dots each formed by the maximum number of drops.

As shown in FIG. 5, a solid image having no spaces can be formed with dots Dm whose area $Sm=\pi P^2/2$. Note that each dotted-line square indicates a section of one pixel. With the dots Dm, as shown in FIG. 5 for example, when a line having a two-pixel width 2P is to be printed, a thick line having a width 2P+α is actually formed. When a barcode is printed with its line being thicker than intended, the barcode readability by a reader is degraded.

Figure 6:
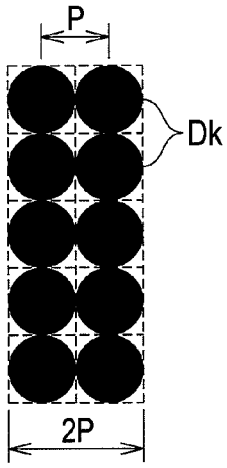
FIG. 6 is a diagram showing dots of an ideal size.

To avoid such a problem, in the printer 1, the number of drops of black ink ejected to form one dot is preset such that the black dot formed on each pixel of the barcode image has a size which most approximates to an ideal size, like dots Dk shown in FIG. 6. The dots Dk shown in FIG. 6 are each a circle inscribed in the dotted-line square, and its area Sk is $\pi P^2/4$. The number of drops of black ink to be ejected to form one dot is held in the table 31 for the number of drops for code printing. The number of drops of black ink per dot in forming a barcode image is set for each type of sheet according to the likelihood of ink bleeding.

In the printer 1, as will be described later, a cyan dot is formed at a position between black dots adjacent in the width direction of the bars in a barcode. The table 31 for the number of drops for code printing holds the number of drops of cyan ink per dot, in association with the number of drops of black ink. The number of drops of cyan ink in the table 31 for the number of drops for code printing is set to be lower than that of black ink. The number of drops of cyan ink is set to such a value that when a cyan dot is formed at a position between black dots, the black ink and the cyan ink will not bleed to make the bar exceed its prescribed width.

The number of drops of cyan ink and that of black ink set in the table 31 for the number of drops for code printing are, for example, values obtained in advance by experiment.

In printing of a barcode image, the controller 5 refers to the table 31 for the number of drops for code printing and thereby determines the number of drops of ink ejected by the inkjet head 3K and that ejected by the inkjet head 3C to each pixel of the barcode image.

Figure 7:
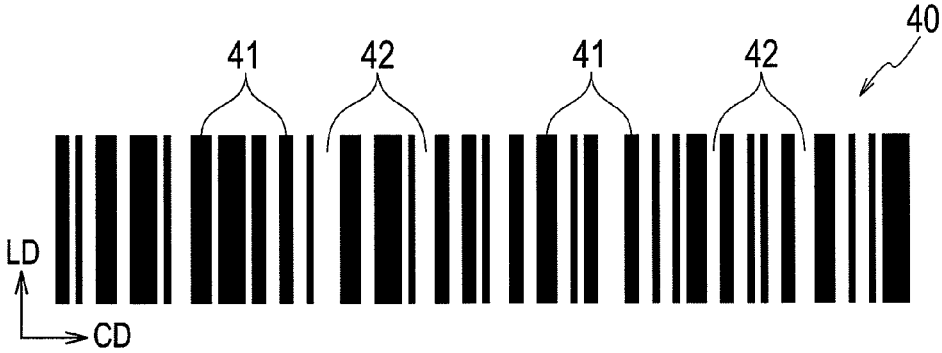
FIG. 7 is a diagram showing an example of a barcode.

FIG. 7 shows an example of a barcode. As shown in FIG. 7, a barcode 40 has multiple thin bars 41 long in the longitudinal direction. The multiple bars 41 are arranged in the crosswise direction (the width direction). A space 42 is formed between each adjacent ones of the bars 41. Information is represented by the widths of the bars 41 and the widths of the spaces 42.

Next, a description is given of an operation performed by the printer 1 in printing an image containing a barcode.

In this embodiment, the barcode 40 having black bars 41 in image data is printed as an example. Herein, the longitudinal direction of the barcode 40 to be printed is in parallel with the conveyance direction of the sheet 10 (a sub scanning direction).

Figure 8:
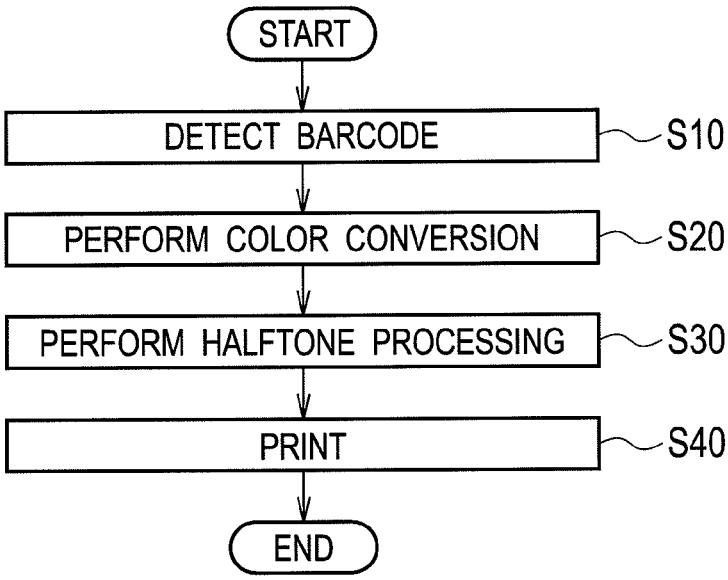
FIG. 8 is a flowchart illustrating an operation performed by the printer in printing an image containing a barcode.

FIG. 8 is a flowchart illustrating the operation performed by the printer 1 in printing an image containing a barcode. The processing of the flowchart in FIG. 8 is started when image data containing an image of the barcode 40 is inputted to the printer 1. The image data inputted to the printer 1 is represented by RGB values herein.

In Step S10 in FIG. 8, the controller 5 detects the barcode 40 in the image data inputted. A method for detecting the barcode 40 in the image data is not particularly limited, and a known method can be used. For example, when the image data has more than a predetermined number of straight lines of the same length arranged successively, the controller 5 determines that these straight lines are the bars 41 constituting the barcode 40, and detects the barcode 40 formed by the straight lines.

Next, in Step S20, the controller 5 performs color conversion (color separation) on the RGB image data to generate image data on each of C, M, Y, and K. The controller 5 performs the color conversion with reference to a lookup table (not shown) recording correspondences between RGB values and CMYK values.

In this event, the controller 5 separates the image of the barcode 40 into a black barcode image and a cyan barcode image. In the cyan barcode image obtained by the controller 5, one of endmost one-pixel-wide lines of each bar 41 in the width direction is deleted.

Figure 9A:
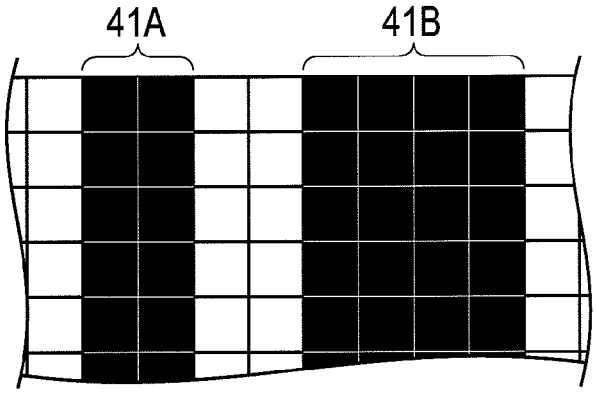
FIG. 9A is a diagram illustrating a barcode image for black.
Figure 9B:
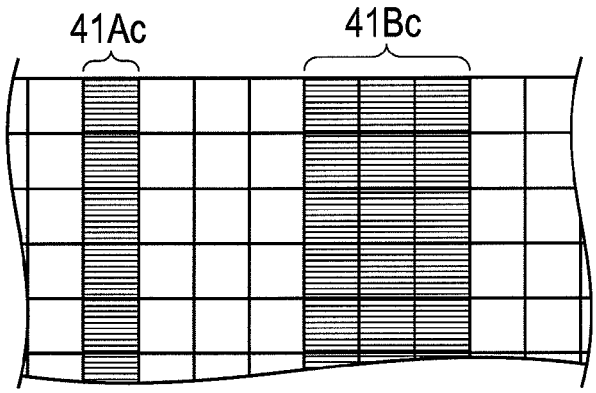
FIG. 9B is a diagram illustrating a barcode image for cyan.

Specifically, assume for example that the barcode 40 contained in the inputted image data has a two-pixel-wide bar 41A and a four-pixel-wide bar 41B, as shown in FIG. 9A. In this case, the image data on black obtained by the color conversion has the bars 41A and 41B shown in FIG. 9A. On the image data on cyan, the controller 5 performs processing for generating bars 41Ac and 41Bc shown in FIG. 9B in the color conversion. Note that each square in FIGS. 9A and 9B indicates one pixel. The bars 41Ac and 41Bc are obtained by deleting the rightmost one-pixel-wide line from each of the bars 41A and 41B.

Accordingly, as shown in FIG. 10, the inkjet head 3K is to eject black ink from its nozzles 21*k*1 and 21*k*2 for the bar 41A, and the inkjet head 3C is to eject cyan ink from its nozzle 21*c*1 for the bar 41Ac. Similarly, the inkjet head 3K is to eject black ink from its nozzles 21*k*3 to 21*k*6 for the bar 41B, and the inkjet head 3C is to eject cyan ink from its nozzles 21*c*2 to 21*c*4 for the bar 41Bc. In FIG. 10, the nozzles 21 from which ink is to be ejected in the above example are blacked out.

Next, in Step S30, the controller 5 performs half-tone processing on the image data on C, the image data on M, the image data on Y, and the image data on K to generate drop data for each of the colors, which indicates the number of drops of ink to be ejected to each pixel.

In this event, for the barcode image, the controller 5 refers to the table 31 for the number of drops for code printing, and according to the type of a sheet to be used, determines the number of drops of black ink ejected to each pixel of the black barcode image and the number of drops of cyan ink ejected to each pixel of the cyan barcode image. For example, along with the image data inputted, the controller 5 can acquire information indicating the type of a sheet used for the printing.

Then, in Step S40, the controller 5 executes a printing procedure. Specifically, the controller 5 instructs the head driver 4 to drive the inkjet head 3K, 3C, 3M, and 3Y to eject ink to the sheet 10 being conveyed by the conveyer 2. Thereby, the image containing the barcode is printed on the sheet 10.

In this printing procedure, as shown in FIG. 10 for example, the barcode image is printed by ejection of black ink from the nozzles 21*k*1 and 21*k*2 of the inkjet head 3K to forma black dot at each pixel constituting the bar 41A and by ejection of cyan ink from the nozzle 21*c*1 of the inkjet head 3C to form a cyan dot at each position between the black dots of the bar 41A in the width direction.

As a result of the printing procedure, as shown in FIG. 11, each bar 41 of the barcode image printed is formed by the black dots Dk and the cyan dots Dc formed between the black dots Dk. Since the number of drops of cyan ink in the table 31 for the number of drops for code printing is equal to or less than that of black ink, the size of each cyan dot Dc in the barcode image is smaller than that of each black dot Dk.

Note that the half-pitch displacement of the inkjet head 3C from the other inkjet heads 3K, 3M, and 3Y has almost no influence on the quality of printing a regular image.

As described above, even if spaces are produced by reducing the size of the black dots Dk so that the bar 41 will not exceed its prescribed width, the spaces can be decreased by forming the cyan dot Dc at each position between the black dots Dk formed in the bar 41 having a multiple-pixel width. Thereby, decrease in the barcode density for reading by a reader is suppressed. A general reader uses red light for reading barcodes. Since cyan is a complementary color of red, the reader reads cyan almost like it reads black. For this reason, decrease in the density of a barcode read by the reader can be suppressed by forming the cyan dots Dc at the positions between the black dots Dk.

Further, in this embodiment, the inkjet heads 3K and 3C do not have to be particularly capable of high-resolution printing or minute control of the amount of ink ejected. Just by performing printing according to the preset number of drops, they can print accurately, allowing each bar 41 to have its prescribed width.

Thus, the printer 1 capable of printing a barcode image with degradation in readability suppressed without requiring sophisticated inkjet heads.

Since the number of drops for one cyan dot is equal to or less than that for one black dot in forming a barcode image, increase in the amount of ink used can be suppressed. Thereby, thickening of each bar 41 due to heavy bleeding of ink occurs less. As a result, a barcode image in which degradation in readability is suppressed can be printed.

Since the number of drops for a black dot and that for a cyan dot in printing a barcode image are set for each type of a sheet to be used, degradation in the barcode readability is suppressed even when the barcode is printed on a sheet on which ink easily bleeds.

Alternatively, a cyan dot may be formed for each pixel of a barcode contained in inputted image data, and a black dot may be formed at a position between the cyan dots. In other words, the positional relation between the black and the cyan in FIG. 11 may be reversed. Also in this case, the number of drops for one black dot and the number of drops for one cyan dot are set so that each bar 41 printed may have its prescribed width. Note that it is preferable in this case that the number of drops for one black dot is equal to or more than that for one cyan dot. This is because decrease in the barcode density for reading by a reader is suppressed when the ratio of black is larger.

FIG. 12 shows results of experiments for confirming the effect of quality improvement in a barcode image printed by this embodiment.

In Example 1 in FIG. 12, a barcode image was printed by forming cyan dots at positions between black dots, as shown in FIG. 11. In Example 2, a barcode image was printed by forming black dots at positions between cyan dots, with the relation between black and cyan in Example 1 being reversed. In Comparative Example, a barcode image was printed by forming black dots and cyan dots at the same positions in a superimposing manner.

The number of drops of black ink per dot and that of cyan ink per dot which were adopted in Examples 1 and 2 and Comparative Example were ones of the highest barcode quality rank found by trying multiple combinations. The barcode quality rank was judged using a commercially-available barcode verifier.

The printed images were each ranked for the effect of improvement in barcode quality as follows using a barcode image printed with only black as the standard. When a barcode image had a barcode quality rank higher than that of the standard barcode image, the barcode image was ranked A (quality improved). When a barcode image had a barcode quality rank equal to that of the standard barcode image, the barcode image was ranked B (quality unchanged). When a barcode image had a barcode quality rank lower than that of the standard barcode image, the barcode image was ranked C (quality degraded).

Sheets used in the experiments were, as shown in FIG. 12, inkjet (IJ) matte sheets, IJ sheets, and two types of plain sheets A and B. The lower the sheets are listed in FIG. 12, the easier ink bleeds thereon.

As shown in FIG. 12, barcode images printed in Examples 1 and 2 have higher quality than that printed in Comparative Example.

In the above embodiment, each cyan dot Dc is formed at the exact middle between the black dots Dk adjacent in the width direction of the bar 41, as shown in FIG. 11. However, the cyan dot Dc does not have to be formed at the middle, but only has to be formed with the center thereof located anywhere between the centers of the black dots Dk adjacent in the width direction. The same is true for the case where the positional relation between the black and the cyan is reversed.

In the above embodiment, as shown in FIG. 11, the black dot Dk and the cyan dot Dc are at the same position in the longitudinal direction (the sub scanning direction). However, the longitudinal position of the cyan dot Dc is not limited to this. The same is true for the case where the positional relation between the black and the cyan is reversed. For example, in FIG. 11, the cyan dot Dc may be formed at a position displaced from the black dots Dk by a half pixel in the longitudinal direction. The longitudinal position of the cyan dot Dc can be adjusted by controlling the timing at which the inkjet head 3C ejects ink. In such a case where the cyan dot Dc is displaced from the black dots Dk in the longitudinal direction, a barcode image in the cyan image data obtained by the color conversion may be one in which one of longitudinally endmost one-pixel-wide lines of each bar is deleted. Specifically, the cyan image data after the color conversion may be one in which one of longitudinally endmost one-pixel-wide lines of each bar, such as the bar 41Ac and 41Bc shown in FIG. 9, is deleted. Thereby, in the bar 41, the cyan dot Dc does not protrude from the black dots Dk in the longitudinal direction.

In the above embodiment, the longitudinal direction of the barcode 40 to be printed is in parallel with the conveyance direction of the sheet 10 (the sub scanning direction). When the longitudinal direction of the barcode 40 is orthogonal to the conveyance direction of the sheet 10, the cyan dots Dc are formed at the positions between the black dots Dk adjacent in the width direction of the bar by controlling the timings at which the inkjet head 3C ejects ink. The same is true for the case where the positional relation between the black and the cyan is reversed.

The barcode 40 is printed with black ink and cyan ink in the above embodiment, but the combination of colors is not limited to this. For example, in a printer having two inkjet heads both ejecting black ink, one of the inkjet heads may form the black dot Dk for each pixel of the bar 41, and the other inkjet head may form a black dot to each position between the black dots Dk.

Although the barcode 40 is printed in the above embodiment, the present invention is applicable to a case of printing an image of a different type of information code.

Although the printer 1 employed in the above embodiment is an inkjet printer, the present invention is not limited to this, and is applicable to any printer as long as it is configured to print an image by forming dots.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A printer comprising:

a first printing unit configured to apply a first recording material on a print medium to form a first set of dots on the print medium;

a second printing unit configured to apply a second recording material on the print medium, with the first set of dots formed by the first printing unit, to form a second set of dots on the print medium;

a memory storing in advance a table holding a first number of drops to form each dot in the first set of dots to form a code image and a second number of drops to form each dot in the second set of dots to form the code image, wherein the first number of drops is less than a maximum number of drops required to form one dot of an image in the first set of dots, and wherein the maximum number of drops is preset based on the print medium, and the second number of drops is preset in association with the first number of drops; and a controller configured to control the first and second printing units, wherein the controller is configured, in printing the code image contained in an inputted image data, to drive the first printing unit to form each dot in the first set of dots on a respective pixel of the code image contained in the inputted image data with the first number of drops held in the table stored in the memory, and wherein the controller is configured, in printing the code image contained in the inputted image data, to drive the second printing unit to form each dot in the second set of dots in a position between two adjacent dots from the first set of dots in a width direction of a region with a width of two or more pixels having the first dots formed by the first printing unit with the second number of drops held in the table stored in the memory.

2. The printer according to claim 1, wherein the second number of drops is equal to or less than the first number of drops.

3. The printer according to claim 1, wherein the first number of drops and the second number of drops depend on a likelihood of ink bleeding of the print medium.

4. The printer according to claim 1, wherein the first recording material is an ink of a color other than black, the second recording material is an ink of black, and the first number of drops is equal to or less than the second number of drops.

5. The printer according to claim 1, wherein the first printing unit comprises first nozzles arranged at equal intervals in a main scanning direction, the second printing unit comprises second nozzles arranged at equal intervals in the main scanning direction, and the second nozzles are displaced from the first nozzles in the main scanning direction.

* * * * *